US009452516B2

(12) United States Patent
Alavi

(10) Patent No.: US 9,452,516 B2
(45) Date of Patent: Sep. 27, 2016

(54) SOCKET FOR SOCKET WRENCH

(71) Applicant: Pouria Alavi, Agoura Hills, CA (US)

(72) Inventor: Pouria Alavi, Agoura Hills, CA (US)

(73) Assignee: Pouria Alavi, Agoura Hills, CA (US)

( * ) Notice: Subject to any disclaimer, the term of this patent is extended or adjusted under 35 U.S.C. 154(b) by 105 days.

(21) Appl. No.: 14/176,957

(22) Filed: Feb. 10, 2014

(65) Prior Publication Data

US 2015/0224633 A1 Aug. 13, 2015

(51) Int. Cl.

| | |
|---|---|
| ***B25B 13/06*** | (2006.01) |
| ***B25B 23/10*** | (2006.01) |
| ***B25B 15/00*** | (2006.01) |
| *B25B 23/12* | (2006.01) |

(52) U.S. Cl.

CPC ..... *B25B 23/108* (2013.01); *B25B 13/06* (2013.01); *B25B 15/008* (2013.01); *B25B 23/12* (2013.01)

(58) Field of Classification Search

CPC ..... B25B 23/12; B25B 13/06; B25B 23/108
USPC ..... 81/125, 121.1
See application file for complete search history.

(56) References Cited

U.S. PATENT DOCUMENTS

| | | | | |
|---|---|---|---|---|
| 3,007,726 | A * | 11/1961 | Parkin | 403/372 |
| 3,027,609 | A * | 4/1962 | Parkin et al. | 403/297 |
| 4,416,173 | A * | 11/1983 | Rebish | 81/185 |
| 4,724,730 | A * | 2/1988 | Mader et al. | 81/53.2 |
| 6,098,504 | A | 8/2000 | Hu | |
| 6,170,363 | B1 | 1/2001 | Hu | |
| 6,178,854 | B1 * | 1/2001 | Shih | 81/125 |
| 6,705,813 | B2 * | 3/2004 | Schwab | 411/526 |
| 7,290,467 | B2 * | 11/2007 | Harker | 81/125 |
| 7,437,975 | B1 * | 10/2008 | De Anfrasio | 81/121.1 |
| 7,712,747 | B2 | 5/2010 | Hu | |
| 7,765,898 | B2 * | 8/2010 | Sakaguchi et al. | 81/60 |
| 2003/0110903 | A1 * | 6/2003 | Creek | 81/125 |

* cited by examiner

*Primary Examiner* — Hadi Shakeri
*Assistant Examiner* — Danny Hong
(74) *Attorney, Agent, or Firm* — Michael D. Harris; SoCal IP Law Group LLP

(57) ABSTRACT

Radially spaced blades extending into grooves in the faces of a socket for socket wrenches. Each blade has a curved face facing a bolt head inserted into the socket and an opposite curved face against respective grooves in the bolt face. The blades engaging a hex-head of a bolt inserted into the socket. Applying torque to the socket against resistance from the bolt, urges the blades against their respective groove to secure the bolt head in the socket. The shaft of an Allen wrench is secured in the socket so that its head does not interfere with the head of a hex bolt inserted into the socket. When the Allen wrench is released from its recessed position, the Allen wrench can move upward toward the socket's open end where it can engage an Allen bolt head.

3 Claims, 8 Drawing Sheets

SOCKET FOR SOCKET WRENCH

BACKGROUND

1. Field

Tools especially sockets for use in socket wrenches for driving and holding screws, nuts and bolts with hex heads or Allen wrench heads. Any difference between screws, nuts and bolts generally is not important to this application. Therefore, this application refers to them as "bolts" except where the distinction may be necessary.

2. General Background and State of the Art

Standard socket wrenches usually have two major parts, a handle, which a user can grip, and a socket, which can attach to the handle. The handles' ratcheting mechanism allows the socket to move freely in one direction while the socket remains fixed to the handle when the handle is rotated in the other direction. A switch changes the wrench between tightening and loosening modes. The handle also has a stud, which is inserted into a drive on the socket. Some socket wrenches drive their sockets from the outside of the socket such that the wrench acts on the outside of the base of sockets.

The open end of the socket accepts bolts' hex heads. The typical socket wrench accepts different size sockets, one size for each different size bolt head. Many sockets have six points to conform to bolts' hex head. "Points" are the pointed corners between the faces although the corners often are filleted. Twelve-point sockets have 12 faces such that a common six-sided hex head can be positioned within the socket in one of 12 orientations, each 30° apart. The application refers to "hex heads," but the term is intended to cover other unconventional polygonal shapes such as squares, pentagons and octagons.

A common use for socket wrenches is driving and removing machine bolts into threaded holes and removing a nut from a bolt thread, but the wrenches also can drive and remove self-threading screws and bolts and wood screws respectively into non-threaded holes and wood. The application discusses bolts into threaded openings and nuts around threaded bolts with the understanding that self-threading screws and bolts and wood screws are included.

When a user installs a bolt into a threaded opening, he or she puts the head into the socket by aligning the faces of the head with corresponding socket faces. The socket is sized to leave a small amount of space between the socket's inside and the outside of the proper hex bolts' head to allow easy insertion of the bolt into the socket. However, the space that allows easy insertion also can allow the bolt to fall from the socket as the user tries to insert the bolt into a threaded opening, Likewise, when users remove a bolt from a threaded opening, they put the socket over the head. Then they turn the wrench counterclockwise until the bolt is unscrewed from its threaded opening. When the user pulls back of the socket wrench, the bolt often falls out of the socket. This may not occur if the socket or bolt is magnetic and the other part is iron.

The problem with inserting or removing the bolt is more pronounced for vertical or nearly vertical openings because of gravity. In many applications such as vehicles and airplanes, when the bolt falls from the socket, it falls into difficult-to-reach locations. Retrieving the bolt wastes time, but leaving a dropped bolt near moving parts may be unsafe.

Others have proposed solutions to this problem. Most involve mounting flat springs in the socket that are positioned along one or more faces or at the intersections of two faces. Inserting a bolt flexes the springs outward, and the restoring force from the springs holds the bolt head. Hu, U.S. Pat. No. 6,098,504 (2000) is an example as are U.S. Pat. No. 6,170,363 (2001) and U.S. Pat. No. 7,712,747 (2008), both to Hu. The springs remain out of contact with the inside face or groove of the socket until a bolt is inserted into the socket. These devices have the following drawbacks. When the socket applies high torque to the head, the springs may deform, which can cause the head to move relative to the springs. Further, only a small area of the spring contacts the bolt head and the socket when the springs bend from a bolt's force. This small area may be insufficient to prevent the bolt from jumping between faces especially when the springs deform.

Some bolts have a round head and a hex-shaped opening in the head. The hex-shaped opening receives the head of an Allen wrench. In many instances, a person repairing a vehicle or performing another task must switch between driving bolts with a socket wrench and an Allen wrench. This may be cumbersome. Some Allen wrenches can be driven by a ratchet wrench, but it would be advantageous if the same socket could drive the same size hex and Allen bolts.

SUMMARY

A fitting mounts in a socket of a socket wrench. The fitting has radially spaced blades extending into grooves in at least some of the socket faces. Each blade has a curved face facing a bolt head inserted into the socket and an opposite curved face against respective grooves in the bolt face.

The shaft of an Allen wrench rests on a support in the socket. The Allen wrench is secured in a recessed position so that it does not interfere with a hex-head being inserted into the socket. The base of the Allen wrench extends into an opening in the socket. When the mechanism holding the Allen wrench is released from its recessed position, the Allen wrench can move upward toward the socket's open end where it can engage an Allen bolt head. The fitting for holding a hex head is out of the way of an Allen bolt so that Allen bolts may be driven with the Allen wrench in its recessed position.

BRIEF DESCRIPTION OF THE DRAWINGS

In FIG. 4, the Allen wrench and component for positioning the Allen wrench is present; if is removed in FIG. 5.

Reference numbers for components may not be used in every drawing figure, and insofar as the detailed description references one or more drawing figures, the application does not imply that the component is not visible in other figures.

DETAILED DESCRIPTION

Figure 1:
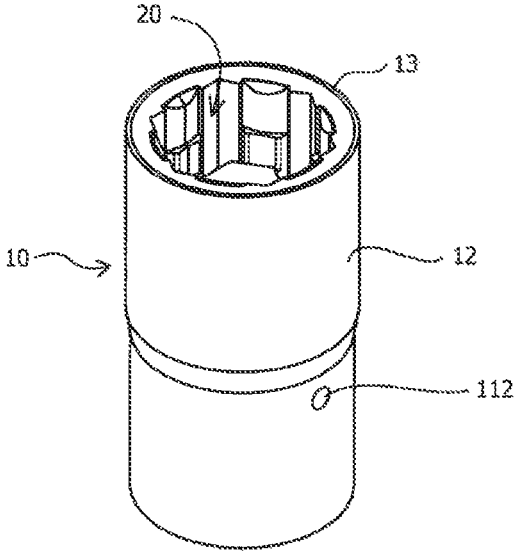
FIG. 1 is a perspective view of the socket.
Figure 2:
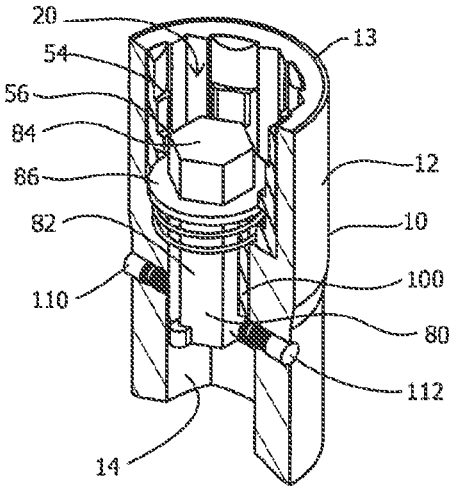
FIG. 2 is a partial sectional view of the socket in FIG. 1.
Figure 3:
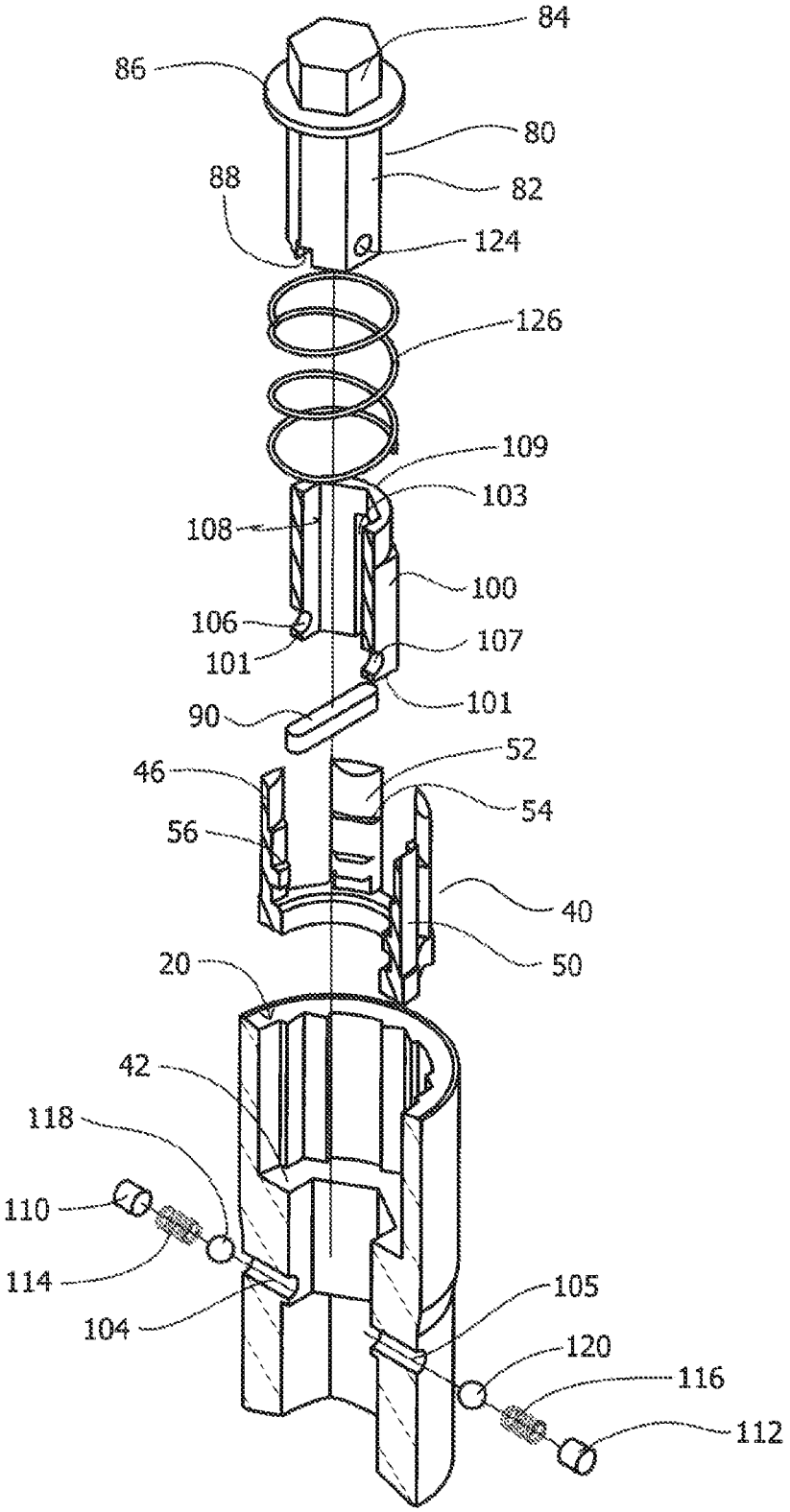
FIG. 3 is an exploded, sectional view of the socket in FIG. 1
Figure 4:
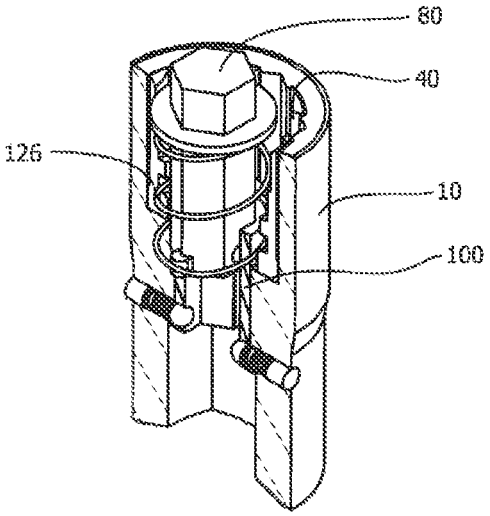
FIGS. 4 and 5 are sectional views of the socket.

Socket 10 (FIG. 1 and others) attaches to a socket wrench (not shown). The socket has a cylindrical body 12 around two openings 14 and 20. Sockets typically are available in different size to accommodate different sizes of bolts. In the United States, sockets are usually available in SAE sizes (fractions of an inch) and metric sizes. Opening 14 is commonly called the "drive." Drives have four common sizes: ¼ in., ⅜ in., ½ in. and ¾ in., and they are square. The drive receives a square mating stud (not shown), which is part of the socket wrench. Studs usually have a ball urged outward to engage the drive, and some drives have a detent to receive the ball. The ball helps to hold the stud in the drive while the socket wrench is in use.

Some socket wrenches have a center opening rather than a drive. The opening is connected to a ratchet mechanism. The bottom of sockets for this type of socket wrench has an outer profile for the center opening to engage.

Opening 20 at the driving end of the socket 10 receives heads 16 or 17 of conventional bolts (FIGS. 10-15). The threaded portions 18 of the bolts may be standard. The opening has faces 22 and points 24. See FIG. 5 where the flat sections and points are most visible. The faces may be generally flat or slightly curved, and the points are the pointed or filleted corners between the faces. The opening in FIG. 5 has six faces and six points to receive a hex head. The horizontal cross-section of the socket is a hexagon (or other polygon if the socket has fewer or more than six faces). Thus, the inside of the socket can be considered a polygonal cylinder. The six flat sides of a hex bolt are aligned with the socket faces, and the bolt's corners are at the points.

Figure 5:
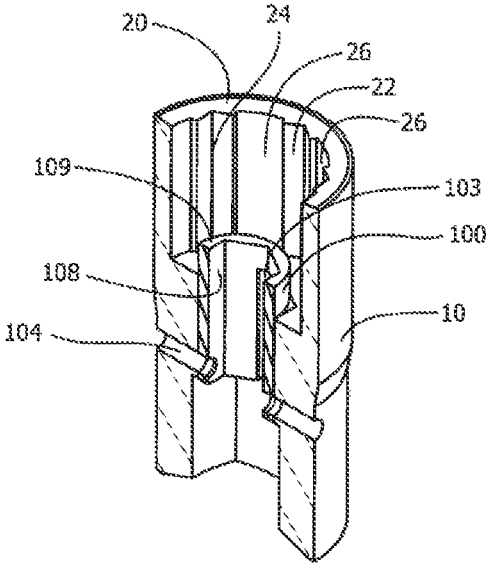
Figure 6:
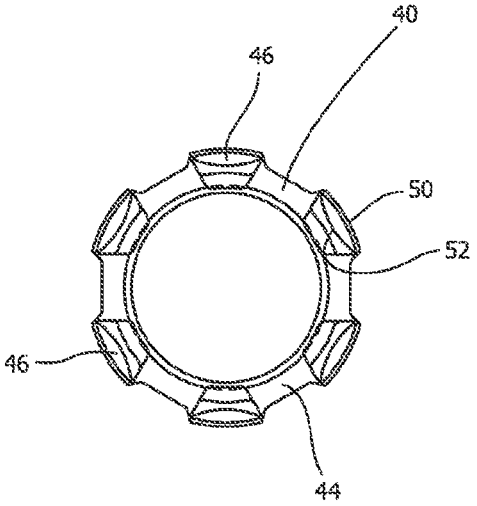
FIG. 6 is a plan view of a socket component.
Figure 7:
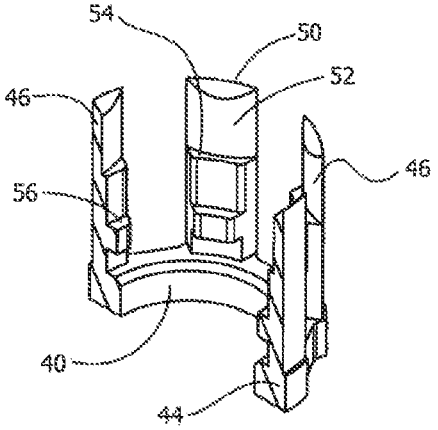
FIG. 7 is a cutaway perspective of the component.

Face 22 includes a vertical groove 26. In FIG. 5 and other figures, each face has a groove, but having a groove for every face may be unnecessary. Ring 40 (best viewed in FIGS. 6, 7 and 10) mounts on shoulder 42 formed on the inside of the socket. The ring includes a cylindrical base 44 and upright blades 46. When the ring is positioned in the socket, the blades extend upward through grooves 26. FIG. 6 shows six blades, one for each groove, but even if the socket has six grooves, having fewer than six blades may be acceptable.

Each upright blade 46 has two curved faces. Outside face 50 faces outward and is next to its respective groove 26. Inside face 52 faces inward to contact a hex bolt head when the head is inserted into the socket. The blades' inside faces may each have a shoulder 54. When ring 40 mounts in the socket, the shoulder is positioned to act as a stop for hex bolt head 16 and holds the bolt head such that the entire head is within the socket. See FIG. 10, which shows surface 19 of the head aligned with the top of the socket. However, the shoulders could be positioned to allow the head to go further into the socket.

When a user inserts bolt head 16 into the socket, the head contacts inside faces 52 of upright blade 46. See FIG. 7. The blades apply sufficient force against the head to hold the head in the socket. When a user applies sufficient torque to the socket, the bolt head pushes against the blades so that the blades apply force against their respective groove 26. See FIG. 5. Consequently, the force applied by inside face 52 of each blade to the bolt head increases.

When using prior art flat blades between the bolt head and the socket face, torque on the socket and onto the bolt head tends to twist or deform the flat blades. That twisting can cause only a small region of the blade to engage the bolt head while another small region engages the inside of the socket. That smaller contact between the blade and the bolt head results in less force between them. Especially if the head has rounded corners, the socket may slip on the head.

With curved faces 50 and 52 and for blade 46, any force from bolt head 16 that is sufficient to twist the blade causes the contact point from the blade on the bolt to remain at or near the center of the blade and groove 26. Therefore, the blade exerts more force on the bolt than a flat blade would exert. Accordingly, bolt heads rotate less if at all relative to the socket than bolt heads rotate with flat blades so that heads with rounded corners are less likely to jump to the next point.

Figure 8:
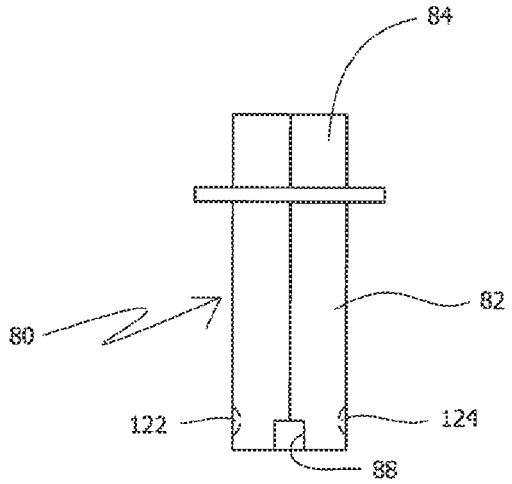
FIG. 8 is a side view of the Allen wrench component.
Figure 9:
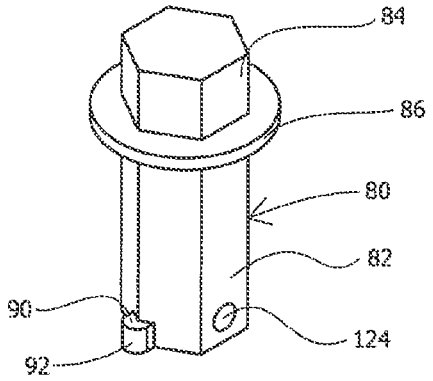
FIG. 9 is a perspective view of the Allen wrench component.
Figure 10:
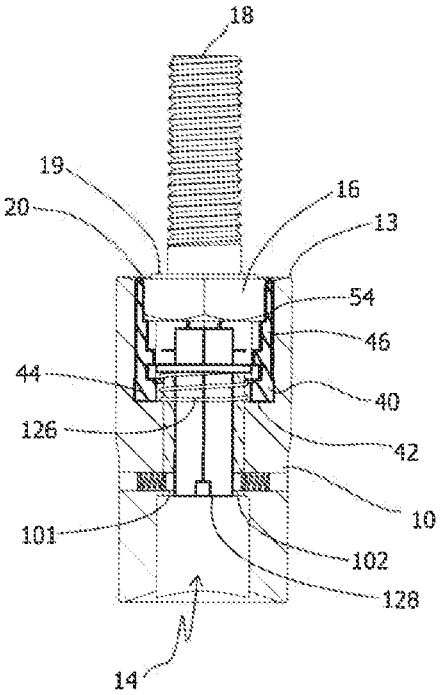
FIG. 10 is a sectional view of the socket with a hex bolt within the socket.
Figure 11:
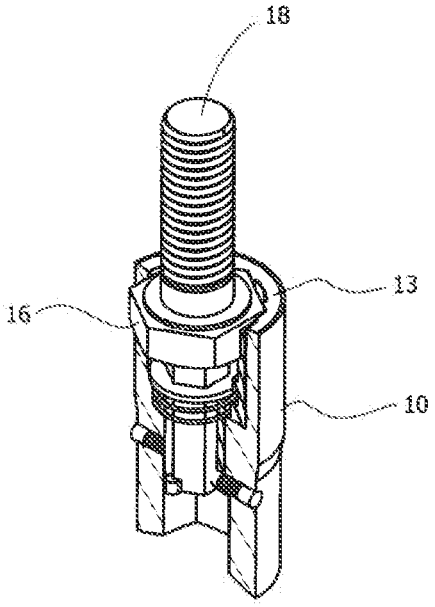
FIG. 11 is a cutaway perspective view of the socket with a hex bolt within the socket.

The socket also can drive Allen bolts. Allen wrench shaft 80 (best viewed in FIGS. 2, 3, 8, 9, 12 and 13) mounts within socket 10. The shaft includes shank 82 and head 84 (FIGS. 8 and 9). The head is hex-shaped to engage corresponding hex openings in Allen bolts.

Base 101 of fitting 100 may mount on shoulder 102 in socket 10 so that the fitting mounts inside opening 20 in the socket. See FIGS. 3, 5, 10, 12 and 13. Depending on the socket size, the fitting may be aligned with the shoulder. The fitting is a separate component in those figures, but it could be formed as an integral part of the inside of socket 10. Inside 108 of the fitting has the same inside shape as the outside of the shank to prevent Allen wrench shaft 80 from rotating in socket 10. The fitting has a pair of vertical side grooves 103, only one of which is visible in FIGS. 3 and 5. Bottom slot 88 in shank 82 (FIG. 8) receives peg 90. Ends 92 of the peg (FIG. 9) extend into the side grooves. The tops of the side grooves act as stops to prevent the Allen wrench shaft from falling from the top of the socket.

Likewise, to prevent the Allen wrench shaft 80 from falling from the bottom of socket 10, disk 86, which extends around shank 82 below head 84 engages the top of hex fitting 109 when the Allen wrench shaft is pushed down. Though the drawings show a disk, one or more flanges or other projections can be used instead of a disk.

Opposing bores 104 and 105 extend through the wall of the socket. The bores align with holes 106 and 107 through fitting 100. Pins 110 and 112 extend into the bores, and they are secured in the positions shown in FIGS. 2, 10, 11, 12 and 13. Coil springs 114 and 116 or other resilient members also mount in the bores, and balls 118 and 120 mount on the inside of the springs. Shank 82 of Allen wrench shaft 80 has opposed detents 122 and 124 (FIGS. 8 and 9). When the socket is being used to drive hex-head bolts, the balls project into the detents to secure the Allen wrench in its down (FIGS. 10 and 11) position. Other detent engaging members could replace the balls.

Figure 12:
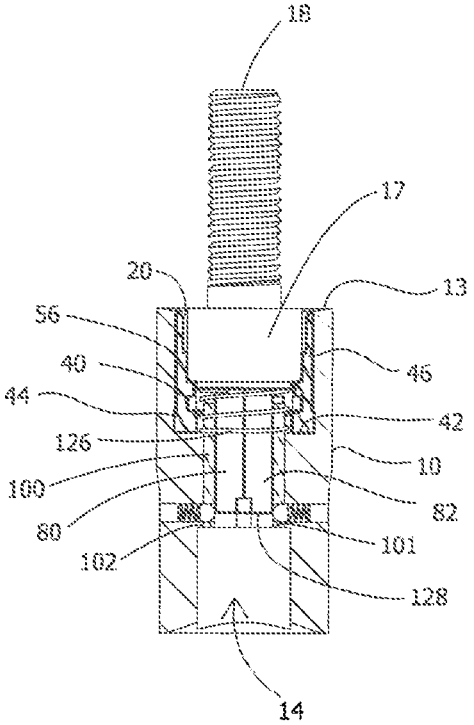
FIG. 12 is sectional view of the socket with an Allen bolt within the socket.
Figure 13:
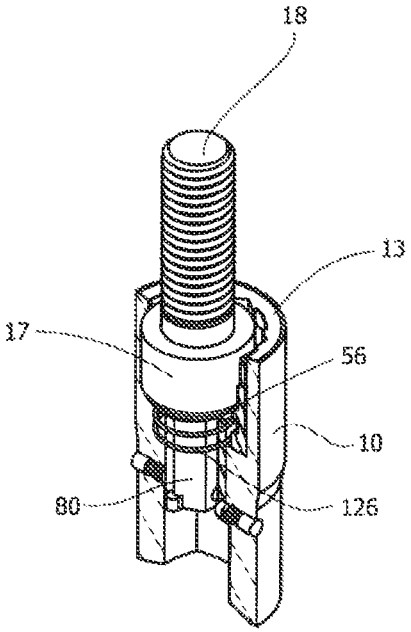
FIG. 13 is a cutaway perspective view of the socket with an Allen bolt within the socket.
Figure 14:
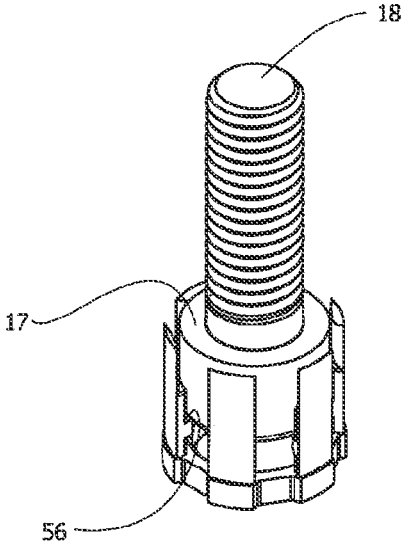
FIG. 14 is a perspective view of a bolt having an Allen wrench head in the component that holds bolt heads in the socket.
Figure 15:
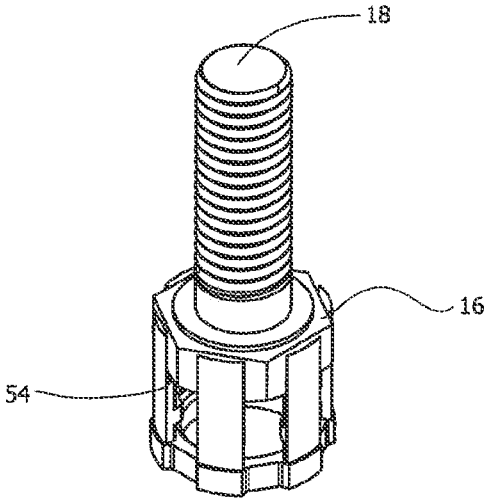
FIG. 15 is a perspective view of a bolt having a hex head in the component that holds bolt heads in the socket.

Pushing Allen wrench shaft 80 upward releases balls 118 and 120 from detents 122 and 124 to position hex head 84 where it can receive the hex opening in an Allen bolt. Head 17 of an Allen bolt may have a nominal thickness (top to bottom) greater than the nominal thickness of the head of a hex bolt. Accordingly, lower shoulder 56 instead of upper shoulder 54 of blades 46 supports the top of the Allen bolt head (the bottom when viewed in FIGS. 12 and 13). This arrangement prevents the Allen wrench detents 122 and 124 from engaging balls 118 and 120. Coil spring 126 may urge the shaft upward. At the same time, ends 92 and 93 of peg 90 contact the top of vertical groove 103. As the figures show, the outside of the Allen bolt contacts upright blade 46. Because the bolt applies an outward force against the blade, the blade secures the Allen bolt in the socket. After using the socket for driving Allen bolts, users can push down on the Allen wrench until the balls engage detents 122 and 124. In that position of the Allen wrench, users can use the socket for driving hex bolts An advantage of having the heads of Allen bolts positioned as shown in FIGS. 12 and 13 occurs when driving the bolts into a counter bore hole. Because the bolt head is secured by blades 46 ring component 40, the bolt can be screwed safely in a counter bore hole. As the bolt is screwed into the hole, the top of the socket contacts the area around the bore. Continuing to turn the socket releases the bolt from the blades while spring coil 126 pushes Allen wrench 80 up and against the hex opening of the bolt into the counter bore hole.

The description is illustrative and not limiting and is by way of example only. Although this application shows and describes examples, those having ordinary skill in the art will find it apparent that changes, modifications or alterations may be made. Many of the examples involve specific combinations of method acts or system elements, but those acts and those elements may be combined in other ways to accomplish the same objectives. With regard to flowcharts, additional and fewer steps may be taken, and the steps as shown may be combined or further refined to achieve the methods described. Acts, elements and features discussed only in connection with one embodiment are not intended to be excluded from a similar role in other embodiments.

Words such as "top," "bottom," "upper" and "lower" refer to the orientation of components in the drawing. "Plurality" means two or more. A "set" of items may include one or more of such items. The terms "comprising," "including," "carrying," "having," "containing," "involving," and the like in the written description or the claims are open-ended, i.e., each means, "including but not limited to." Only the transitional phrases "consisting of" and "consisting essentially of" are closed or semi-closed transitional phrases with respect to claims. The ordinal terms such as "first," "second," "third," etc., in the claims to modify a claim element do not by themselves connote any priority, precedence, or order of one claim element over another or the temporal order in which acts of a method are performed. Instead, they are used merely as labels to distinguish one claim element having a certain name from another element having a same name (but for use of the ordinal term). Alternatives such as "or" include any combination of the listed items.

I claim:

1. A socket for a socket wrench, the socket comprising:

a driven end attachable to a socket wrench and a driving end opposite to the driven end and adapted to receive the head of a bolt, the driving end having a top, an inside and an outside;

inside faces being spaced about the inside of the driving end to form a polygonal cylinder, the faces being separated by points, and at least one of the faces having a groove;

at least one blade mounted in the socket and extending at least partially along a corresponding groove, the at least one blade having a curved outer face adjacent the corresponding groove and an inner face extending away from the corresponding groove, the at least one blade being positioned to contact a polygonal bolt head received in the driving end;

a first shoulder facing away from the corresponding groove of the at least one blade, the first shoulder being positioned to block insertions of a polygonal bolt head past the first shoulder; and a second shoulder facing away from the corresponding groove of the at least one blade and spaced farther than the first shoulder from the top of the driving member, the second shoulder being positioned to block insertions of a bolt head having a smaller outer dimension than the polygonal bolt heads that the first shoulder blocks.

2. A socket for a socket wrench, the socket comprising:

a driven end attachable to a socket wrench and a driving end opposite to the driven end and adapted to receive the head of a bolt, the driving end having a top, an inside and an outside;

inside faces being spaced about the inside of the driving end to form a polygonal cylinder, the faces being separated by points, and at least one of the faces having a groove;

at least one blade mounted in the socket and extending at least partially along a corresponding groove, the at least one blade having a curved outer face adjacent the corresponding groove and an inner face extending away from the corresponding groove, the at least one blade being positioned to contact a polygonal bolt head received in the driving end;

an Allen wrench mounted in the socket, the Allen wrench having a head facing the top of the socket and a shank facing away from the head, the Allen wrench being moveable between a down position in which the head of the Allen wrench is positioned out of way of a polygonal bolt head inserted into the top of the socket, the Allen wrench being moveable to an up position in which the head of the Allen wrench can engage an Allen bolt inserted into the driving end of the socket; and a fitting inside the socket, the fitting having at least one slot with a closed end, the shank of the Allen wrench having at least one peg in the slot, the closed end blocking movement of the Allen wrench out of the top of the driving end.

3. A socket for a socket wrench, the socket comprising:

a driven end attachable to a socket wrench and a driving end opposite to the driven end and adapted to receive the head of a bolt, the driving end having a top, an inside and an outside;

inside faces being spaced about the inside of the driving end to form a polygonal cylinder, the faces being separated by points, and at least one of the faces having a groove;

at least one blade mounted in the socket and extending at least partially along a corresponding groove, the at least one blade having a curved outer face adjacent the corresponding groove and an inner face extending away from the corresponding groove, the at least one blade being positioned to contact a polygonal bolt head received in the driving end;

an Allen wrench mounted in the socket, the Allen wrench having a head facing the top of the socket and a shank facing away from the head, the Allen wrench being moveable between a down position in which the head of the Allen wrench is positioned out of way of a polygonal bolt head inserted into the top of the socket, the Allen wrench being moveable to an up position in which the head of the Allen wrench can engage an Allen bolt inserted into the driving end of the socket; and at least one socket bore into the inside of the socket, the Allen wrench having a detent aligned with the socket bore, a resilient member in the bore, and a detent engaging member at the inside of the socket bore engaging the detent.

* * * * *